US012024970B2

(12) United States Patent
Hiorth et al.

(10) Patent No.: US 12,024,970 B2
(45) Date of Patent: Jul. 2, 2024

(54) WELL TOOL DEVICE AND METHOD OF FORMING A PERMANENT WELL BARRIER, CONFIGURED TO GENERATE A FORCED FLOW OF MOLTEN MASS

(71) Applicant: INTERWELL P&A AS, Hafrsfjord (NO)

(72) Inventors: Espen Hiorth, Trondheim (NO); Michael Skjold, Ranheim (NO)

(73) Assignee: INTERWELL P&A AS, Hafrsfjord (NO)

( * ) Notice: Subject to any disclaimer, the term of this patent is extended or adjusted under 35 U.S.C. 154(b) by 101 days.

(21) Appl. No.: 17/754,037

(22) PCT Filed: Sep. 21, 2020

(86) PCT No.: PCT/EP2020/076253

§ 371 (c)(1),
(2) Date: Mar. 22, 2022

(87) PCT Pub. No.: WO2021/058424

PCT Pub. Date: Apr. 1, 2021

(65) Prior Publication Data

US 2022/0372833 A1 Nov. 24, 2022

(30) Foreign Application Priority Data

Sep. 23, 2019 (NO) ..... 20191145

(51) Int. Cl.
*E21B 33/13* (2006.01)
*E21B 33/12* (2006.01)
(Continued)

(52) U.S. Cl.
CPC ..... *E21B 33/1204* (2013.01); *E21B 33/13* (2013.01); *E21B 37/02* (2013.01); *E21B 41/00* (2013.01)

(58) Field of Classification Search
CPC ..... E21B 33/1204; E21B 33/13; E21B 37/02; E21B 41/00
See application file for complete search history.

(56) References Cited

U.S. PATENT DOCUMENTS 6,523,610 B1 2/2003 Griffith et al.
9,713,799 B2 * 7/2017 Mattson ..... B01F 27/2121
(Continued)

FOREIGN PATENT DOCUMENTS

WO 2012128644 A2 9/2012
WO 2013135583 A2 9/2013
(Continued)

OTHER PUBLICATIONS

International Search Report issued in International Application No. PCT/EP2020/076253, mailed Nov. 30, 2020 (4 pages).
(Continued)

*Primary Examiner* — Taras P Bemko
(74) *Attorney, Agent, or Firm* — Osha Bergman Watanabe & Burton LLP

(57) ABSTRACT

A well tool device for forming a permanent well barrier includes a housing having a circular cross-section and a longitudinal extension; a pyrotechnic mixture provided in the housing; a flow generating device provided in the housing; and a motor for driving the flow generating device. After ignition, the pyrotechnic mixture turns into a molten mass; and the flow generating device is configured to generate a forced flow of the molten mass. A method for forming a permanent well barrier using the well tool device includes installing the well tool device in a well; and igniting the pyrotechnic mixture. The pyrotechnic mixture turns into a molten mass upon ignition. The method further includes starting the motor; and generating a forced flow of molten mass by the flow generating device.

15 Claims, 12 Drawing Sheets

(51) Int. Cl.
*E21B 37/02* (2006.01)
*E21B 41/00* (2006.01)

(56) References Cited

U.S. PATENT DOCUMENTS

| | | | | |
|---|---|---|---|---|
| 2005/0088907 | A1* | 4/2005 | Vanek | B01F 27/113 366/342 |
| 2006/0144591 | A1 | 7/2006 | Gonzalez et al. | |
| 2015/0211328 | A1 | 7/2015 | Lowry et al. | |
| 2016/0193575 | A1* | 7/2016 | Dinnison | B01F 27/0541 366/343 |
| 2017/0030169 | A1 | 2/2017 | Funkhouser et al. | |
| 2018/0327886 | A1 | 11/2018 | Marya | |
| 2018/0334873 | A1* | 11/2018 | Marya | F42B 3/10 |
| 2018/0340390 | A1 | 11/2018 | Oag et al. | |
| 2019/0032440 | A1* | 1/2019 | Tøndel | E21B 33/1204 |
| 2021/0087904 | A1* | 3/2021 | Hearn | E21B 33/13 |

FOREIGN PATENT DOCUMENTS

| | | | | |
|---|---|---|---|---|
| WO | WO-2014108431 | A2 * | 7/2014 | E21B 23/065 |
| WO | 2019151870 | A1 | 8/2019 | |

OTHER PUBLICATIONS

Written Opinion issued in International Application No. PCT/EP2020/076253; Dated Nov. 30, 2020 (6 pages).
Search Report issued in Norwegian Application No. 20191145; Dated Mar. 25, 2020 (2 pages).

* cited by examiner

WELL TOOL DEVICE AND METHOD OF FORMING A PERMANENT WELL BARRIER, CONFIGURED TO GENERATE A FORCED FLOW OF MOLTEN MASS

TECHNICAL FIELD

The invention relates to a well tool device and a method for permanently plugging and abandoning a well.

BACKGROUND

Plugging and abandonment operations, often referred to as P&A operations, are performed to permanently close oil and/or gas wells. Typically, this is performed by providing a permanent well barrier above the oil and/or gas producing rock types, typically in the cap rock in which the well has been drilled through.

In WO2013/135583 (Interwell P&A AS), it is disclosed a method for performing a P&A operation wherein in a first step, it was provided an amount of a pyrotechnic mixture (for example thermite) at a desired location in the well and thereafter to ignite the pyrotechnic mixture to start a heat generation process. It is also disclosed a tool for transporting the pyrotechnic mixture into the well before ignition.

The heat generating process melts surrounding materials to form the permanent well barrier. Typically, the surroundings to be melted comprise tubing, pipe(s), cement and cap rock. After ignition, the pyrotechnic mixture turns into a molten mass. There is a high temperature difference between the molten mass created by the pyrotechnic mixture and its surroundings. Due to this temperature difference, the temperature within the molten mass will be unevenly distributed. The highest temperatures are seen in the center of the molten mass. The heat generated by the heat generating process is thus not utilized in an optimal manner.

An objective of the present invention is to provide a tool for use in the above-mentioned method which deals with the identified shortcoming.

SUMMARY OF THE INVENTION

The invention provides a device and method for forming a permanent well barrier as set forth in the independent claims. Preferred embodiments are set forth in the dependent claims.

It is an objective of the present invention to provide a device and a method for distributing heat in a well, in particular across the entire cross-section of the well and into the formation.

It is advantageous to have a device and a method which distributes heat from the parts of the molten mass which has the highest temperature to the part of the molten mass which has the lowest temperature.

The highest temperatures are typically found in the central and upper part of the molten mass, whereas the lowest temperatures are typically found in the periphery of the molten mass.

It is described a well tool device for forming a permanent well barrier, the well tool device comprises:

- a housing having a circular cross-section and a longitudinal extension;
- a pyrotechnic mixture provided in the housing;
- a flow generating device provided in the housing;
- a motor for driving the flow generating device;

wherein, after ignition, the pyrotechnic mixture turns into a molten mass; and wherein the flow generating device is configured to generate a forced flow of the molten mass.

It is thus achieved a well tool device with improved heat distribution within the pyrotechnic mixture when the pyrotechnic mixture has turned into a molten mass.

The molten mass melts its surrounding components which then becomes part of the molten mass.

It is also achieved a well tool device which distributes the heat within the molten mass in an improved manner by mixing the melted materials with the pyrotechnic mixture.

It is thus achieved a homogeneous mixture of materials in the molten mass.

It is also achieved a well tool device which distributes heat from the part of the molten mass with the highest temperature to the part of the molten mass with the lowest temperature.

It is also achieved a well tool device with improved supply of heat from the central and upper part of the molten mass to the periphery of the well tool device and subsequently its surroundings, such as tubing, cement and cap rock. In other words, the molten mass created by the heat generating process, is forced into movement such that "fresh" un-hardened molten mass is forced towards the outer periphery of the molten mass with a flow of high speed, continuously exchanging the molten mass which is forced into contact with surrounding materials (e.g. initially housing, then subsequently tubing, cement and cap rock). Without such forced flow of the molten mass, there is a risk that the periphery of the molten mass hardens and that the pyrotechnic mixture burns inside the hardened periphery. This may result in a limited degree of melting of surrounding material as the hardened periphery does not hold the required temperature for further melting of surrounding materials.

It is thus achieved a well tool device which utilizes the pyrotechnic mixture in a more efficient way.

It is thus achieved a well tool device which will speed up the process of forming a permanent well barrier.

The flow generating device of the well tool device may be a foldable impeller, a closed impeller, a single-suction impeller, a dual-suction impeller, a paddle impeller, a propeller, a whisk, a ribbon impeller, an anchor impeller, a turbine type impeller, or combinations thereof.

A flow generating device of the above-mentioned type is particularly suitable for generating a flow of pyrotechnic mixture, and subsequently generating a flow of the molten mass. The type of flow generating device may be selected and adapted based on parameters such as desired direction of flow, flow rate, velocity of output flow, laminar or turbulent flow, speed of rotation, diameter of the well tool device, height of the well tool device, temperature of molten mass, heat distribution within the molten mass etc.

The flow generating device may be a foldable impeller with a plurality of foldable blades, wherein rotation of the flow generating device (60) cause the blades to unfold and the plurality of blades rotates in a circular cross-section which extends beyond the circular cross-section of the housing (20) when the blades are fully unfolded.

It is thus achieved a well tool device with improved supply of heat from the molten mass, to the outside of the well tool device.

As the molten mass gradually extends, the blades of the flow generating device may gradually expand. Before the molten mass has reached the intended extension in a radial direction from the center axis of the housing, the foldable blades of the flow generating device may scrape the surface of surrounding materials.

The foldable blades of the flow generating device may therefore be provided with tips adapted to scrape any contacting surface while maintaining their structural integrity.

The tips of said blades will improve the extension of the molten mass in a radial direction from the center axis of the housing. These tips may also be adapted to tear off parts from the surrounding surfaces on which they scrape, e.g. by being provided with a rough surface, spikes, sharp edges or the like.

The tips of said blades may be made of the same material as the rest of the flow generating device if this material is sufficiently durable. Said tips may also be reinforced by means of geometry, e.g. increased thickness compared to the rest of the flow generating device. The tips may also be reinforced by means of a material with higher hardness then the rest of the flow generating device. Tungsten carbide and diamond are examples of materials with high hardness.

It is thus achieved a well tool device which improves the creation of the permanent well barrier by improving the expansion of the molten mass in a radial direction from the center axis of the housing.

The flow generating device may be made from a material with a higher melting point then the temperature of the molten mass.

A flow generating device made of a refractory metal or a refractory material is suitable for withstanding the temperature reached in the molten mass, caused by the heat generating process of the pyrotechnic mixture after ignition. Any other metal or material able to withstand the temperature of the molten mass may also be suitable. The flow generating device may preferably comprise titanium, vanadium, chromium, manganese, zirconium, technetium, ruthenium, rhodium, hafnium, osmium, iridium, hafnium carbide or boron nitride, more preferably niobium, graphite, molybdenum, tantalum or rhenium, most preferably tungsten. Tungsten is most preferred because it has the highest melting point. The flow generating device may be made of a material comprising any combination of said metals or any alloys of said metals.

The flow generating device may preferably be adapted to generate a forced flow of fluids directed in a radial direction from a center axis of the housing.

This forced flow of fluids is preferably directed from a central part of the well tool device, an upper part of the well tool device or an upper central part of the well tool device.

The velocity of this forced flow of fluids is preferably sufficiently high for the molten mass to reach its surrounding solid materials, such that a concentration of the molten mass with the highest temperature may form in these areas.

The flow generating device may preferably be arranged in a lower half of the compartment.

It is thus achieved a more homogeneous melt as also the heavy materials which tend to sink to the bottom of the melt will be mixed with the rest of the melt.

The well tool device may comprise:

an energy source for powering the motor.

It is thus achieved a well tool device which does not rely on supplied power from topside. The power source may be positioned on the same side of the well tool device as the motor or on the opposite side of the well tool device relative the motor.

The energy source may be a battery or any other means enabling the motor to function for an approximate predefined period of time, e.g. 5 minutes. It could be beneficial to include a timer which controls the supply from the battery to the ignition head and the motor. The timer may be adapted to delay the start of the motor relative to the activation of the ignition head, e.g. by 10-30 seconds.

It is thus achieved a well tool device which will allow the pyrotechnic mixture to turn into the molten mass before the motor operates the flow generating device. This ensures that the motor doesn't waste energy on moving solid phase pyrotechnic mixture.

A timer controlling the supply from the battery to the ignition head and the motor may be adapted to start the motor prior to, simultaneously with or after the activation of the ignition head.

A clutch system may be provided between the motor and the flow generating device.

A temperature sensor may be adapted to control the supply from the battery to the motor. The temperature sensor may be adapted to start the motor once a predetermined temperature is reached in the compartment.

The flow generating device may comprise:

a shaft for connecting the flow generating device to the motor;

wherein the shaft is concentric with the housing.

The shaft may have a through hole through which a power cord may be arranged to provide power from the energy source to the motor when these are not arranged on the same side of the well tool device.

The shaft is preferably pivotally arranged in at least two points of the well tool device, e.g. bushings arranged in the top and the bottom of the well tool device. The shaft may be connected to the flow generating device by means of a keyed joint.

Alternatively, the shaft may be connected to the flow generating device by means of welding. Alternatively, the shaft and the flow generating device may be machined as one item.

The shaft and its arrangement may be made of the same material as the flow generating device or any other material suitable for withstanding the temperature reached in the molten mass, caused by the heat generating process of the pyrotechnic mixture after ignition.

The motor may be arranged below the flow generating device when the well tool device is installed in a well.

A heat insulating device may be arranged in the well tool device to protect a below arranged motor and power source from the pyrotechnic mixture after ignition, as well as for preventing the molten mass from escaping vertically downwards (by means of gravity).

The well tool device may comprise:

a plurality of flow generating devices;

wherein the flow generating devices are axially arranged on the same shaft.

The plurality of flow generating devices may have any given angular offset e.g. 90°, 60°, 45°, 30°, 22.5° or 15°. The plurality of flow generating devices may also be arranged without any angular offset. A typical angular offset may be found by the formula $$\alpha = 360°/n\mathrm{FGD}/nB$$

wherein $\alpha$ is the angular offset of adjacent flow generating devices, nFGD is the number of flow generating devices, nB is the number of blade on each flow generating device. In this case it is a prerequisite that all flow generating devices have the same number of blades.

The flow generating device typically has at least two blades. The blades of the flow generating device typically has an equal angular spacing. If the well tool device comprises a plurality of flow generating devices, the flow generating devices may or may not have the same number of blades.

The motor may be adapted to drive a plurality of flow generating devices arranged on a plurality of shafts, e.g. two shafts with one flow generating device each arranged in a similar manner as a mechanical whisk.

A plurality of motors and energy sources may be arranged to drive a plurality of flow generating devices arranged on a plurality of shafts. E.g. two sets of energy source and motor arranged on opposite sides of the well tool device. Wherein each set of energy source and motor may drive one shaft each.

It is thus achieved a well tool device which provides more power to each flow generating device. This power increase may in turn be used to increase the speed of rotation or rotate a higher number of flow generating devices, as compared to only one set of energy source and motor.

A support device may be arranged in the compartment of the well tool device. The support device may provide a bushing device concentric with a compartment of circular cross-section. The bushing device may be arranged to the housing by means of spokes, beams, etc. The support device may be made of the same material as the flow generating device or any other material suitable for withstanding the temperature of the molten mass.

The bushing device of the support device may have a through hole adapted to house a shaft which endpoints are arranged outside of the bushing device. It is thus achieved a well tool device with improved stability of the shaft.

One or several flow generating devices may be arranged on one or both sides of the support device.

The bushing device of the support device may be adapted to house two shafts which each has one endpoint arranged in the bushing device at opposite sides.

The support device does not divide the compartment in two, i.e. molten mass may travel from one side of the support device to the other side of the support device.

The pyrotechnic mixture may comprise thermite.

The well tool device may comprise:

an ignition device provided within the first compartment, suitable for igniting the pyrotechnic mixture.

When one or several well tool devices are adjacently installed in a well or a plurality of well tool devices are run and installed as a stack, at least one well tool device needs an ignition device suitable for igniting the pyrotechnic mixture. Once the pyrotechnic mixture of one well tool device is ignited, it may in turn ignite the pyrotechnic mixture of any adjacent well tool devices.

Alternatively, several well tool devices may be provided with an ignition head each.

A plurality of well tool devices provided with an ignition head each, may be further provided with a timer. The timer may be programmable to operate all ignition heads simultaneously or in a given order with given time intervals.

It is described a method for forming a permanent well barrier using a well tool device, wherein the well tool device comprises:

a housing having a circular cross-section and a longitudinal extension;

a pyrotechnic mixture provided in the housing;

a flow generating device provided in the housing;

a motor for driving the flow generating device;

wherein the flow generating device is configured to generate a forced flow of fluids within the housing.

The method comprises the steps of:

installing the well tool device in a well;

igniting the pyrotechnic mixture, the pyrotechnic mixture turns into a molten mass upon ignition;

starting the motor; and generating a forced flow of the molten mass by means of the flow generating device.

If the flow generating device is adapted to generate a forced flow of fluids directed in a radial direction from a center axis of the housing, the method may comprise the step of:

directing the forced flow of fluids in the radial direction from a center axis of the housing.

If the flow generating device comprises a foldable impeller with a plurality of foldable blades, the method may comprise the step of:

unfolding the foldable blades of the foldable impeller by means of increasing the rotational speed of the flow generating device.

If the foldable blades are provided with reinforced tips adapted to scrape any contacting surface while maintain their structural integrity, the method may comprise the step of:

scraping the surface of a surrounding solid-state material by means of the tips of the foldable impeller blades.

As used herein, the term "pyrotechnic mixture" or "heat generating mixture" is a particulate mixture of a first metal and an oxide of a second material which, when heated to an ignition temperature, will react spontaneously in an exothermic and self-sustained chemical reaction where the first metal is oxidized to a metal oxide and the second metal is reduced to elementary metal. I.e. the pyrotechnic mixture can be defined as any substance or mixture of substances designed to produce an effect by heat, light, sound, gas/smoke or a combination of these, as a result of non-detonative self-sustaining exothermic chemical reactions. Pyrotechnic substances do not rely on oxygen from external sources to sustain the reaction.

An example of a possible reaction may be the reaction between particulate ferric oxide and particulate aluminium:

$$Fe_2O_3+2Al \rightarrow 2Fe+Al_2O_3$$

Other examples are presented in the detailed description below:

The Pyrotechnic Process

The heat generating mixture (pyrotechnic mixture) 40 comprises a particulate of a first metal and a particulate metal oxide of a second metal in an over-stoichiometric amount relative to a red-ox reaction.

The first metal is oxidized to a metal oxide and the second metal is reduced to elementary metal where the first metal is a different metal than the second metal. Heat is a result of this reaction.

One example of such a pyrotechnic mixture is the following:

$$Fe_2O_3+2Al \rightarrow 2Fe+Al_2O_3+heat \quad (1)$$

Here, the first metal is aluminum (Al) and the second metal is iron oxide (Fe2O3). The first metal is oxidized to the metal oxide aluminum oxide (Al2O3) and the second metal is reduced to the elementary metal iron (Fe). Heat is produced during this process, which often is referred to as a thermite process.

In the above example, the first metal is more reactive than the second metal as defined in a reactivity series of metals.

In alternative embodiments for such a reaction, the first metal in the heat generating mixture or pyrotechnic mixture may be of the following metals: Mg, Al, Ti, Mn, V, Zn, Cr, Mo, Fe, Co, Ni, Sn, Pb, Cu, or B and the metal oxide of the second metal is one of: copperII oxide, chromiumIII oxide, ironII, III oxide, manganeseIV oxide, silicon dioxide, boron trioxide, or leadII, IV oxide. When combining the above, the first metal is more reactive than the second metal as defined in a reactivity series of metals.

Some examples of alternative processes, in which the first metal is aluminum, are disclosed below:

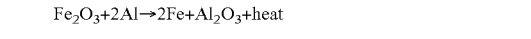

$$Fe_2O_3+2Al \rightarrow 2Fe+Al_2O_3+heat \quad (2)$$

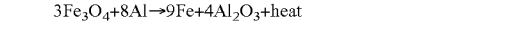

$$3Fe_3O_4+8Al \rightarrow 9Fe+4Al_2O_3+heat \quad (3)$$

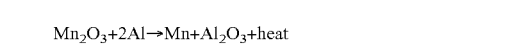

$$3MnO_2+4Al \rightarrow 3Mn+2Al_2O_3+heat \quad (4)$$

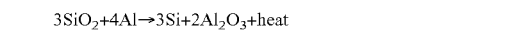

$$Mn_2O_3+2Al \rightarrow Mn+Al_2O_3+heat \quad (5)$$

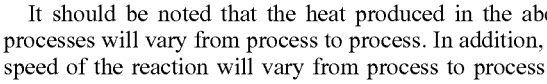

$$3SiO_2+4Al \rightarrow 3Si+2Al_2O_3+heat \quad (6)$$

It should be noted that the heat produced in the above processes will vary from process to process. In addition, the speed of the reaction will vary from process to process.

As mentioned above, it is also possible to use manganese as the first metal, as disclosed below:

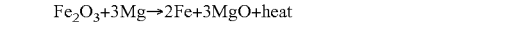

$$Fe_2O_3+3Mg \rightarrow 2Fe+3MgO+heat \quad (7)$$

As used herein, the term "the first metal is more reactive than the second metal" means that the first metal of the pyrotechnic mixture has a higher reactivity than the second metal of the metal oxide. The reactivity of metals is determined empirically and given in reactivity series well known to the person skilled in the art. An example of a reactivity series of metals is found in e.g. Wikipedia: https://en.wikipedia.org/wiki/Reactivity_series After ignition of the pyrotechnic mixture e.g. at the depth of the cap rock, the heat generating mixture will burn with a temperature of up to 3000° C. and melt a great part of the proximate surrounding materials, with or without the addition of any additional metal or other meltable materials to the well. Such a pyrotechnic mixture may also be referred to as a heat generating mixture. The surrounding materials may include any material normally present in the well, and can be selected from a group comprising, but not limited to: tubulars, e.g. casing, tubing and liner, cement, formation sand, cap rock etc. The heat from the ignited mixture will melt a sufficient amount of said materials. When the heat generating mixture has burnt out, the melted materials will solidify forming the reservoir sealing barrier at the first position. If the first position is at the cap rock, the reservoir sealing barrier melts and bonds in a transition area with the cap rock forming a continuous cap rock-to-cap rock barrier. This reservoir sealing barrier seals from inflow from any reservoir(s) below the reservoir sealing barrier. The operation is particularly suitable in vertical sections of the well but may also be suitable in deviating or diverging sections such as horizontal sections or sections differing from a vertical section.

The sufficient amount of heat generating mixture or pyrotechnic mixture, e.g. thermite mixture, varies dependent on which operation that is to be performed as well as the design well path. As an example, NORSOK standard D-010, which relates to well integrity in drilling and well operations, defines that a cement plug shall be at least 50 meters and in some operations up to 200 meters when used in abandonment operations. For example, one may fill whole of the inner volume of the pipe. In the embodiment regarding permanent well abandonment, a pipe having an inner diameter of 0.2286 m (9⅝") has a capacity of 0.037 $m^3$ per meter pipe. In order to provide a 50 meter plug by means of the method according to the invention, one would need 1.85 $m^3$ heat generating mixture comprising thermite. Similarly, if a cement plug of 200 meters is required, the amount of heat generating mixture needed would be 7.4 $m^3$. It should though be understood that other plug dimensions may be used, as the plug provided by means of the invention will have other properties than cement and the NORSOK standard may not be relevant for all applications and operations. Any amount of heat generating mixture may be used, dependent on the desired operation, the properties of the heat generating mixture and the materials.

As used herein the relative terms "upper", "lower", "below", "above", "higher" etc. shall be understood in their normal sense and as seen in a cartesian coordinate system. When mentioned in relation to a well, "upper" or "above" shall be understood as a position closer to the surface of the well (relative to another component), contrary to the terms "lower" or "below" which shall be understood as a position further away from the surface of the well (relative another component).

BRIEF DESCRIPTION OF THE DRAWINGS

The invention will now be described with reference to the exemplifying non-limiting embodiments shown in the accompanying drawings, wherein.

DETAILED DESCRIPTION OF A PREFERRED EMBODIMENT

Figure 1:
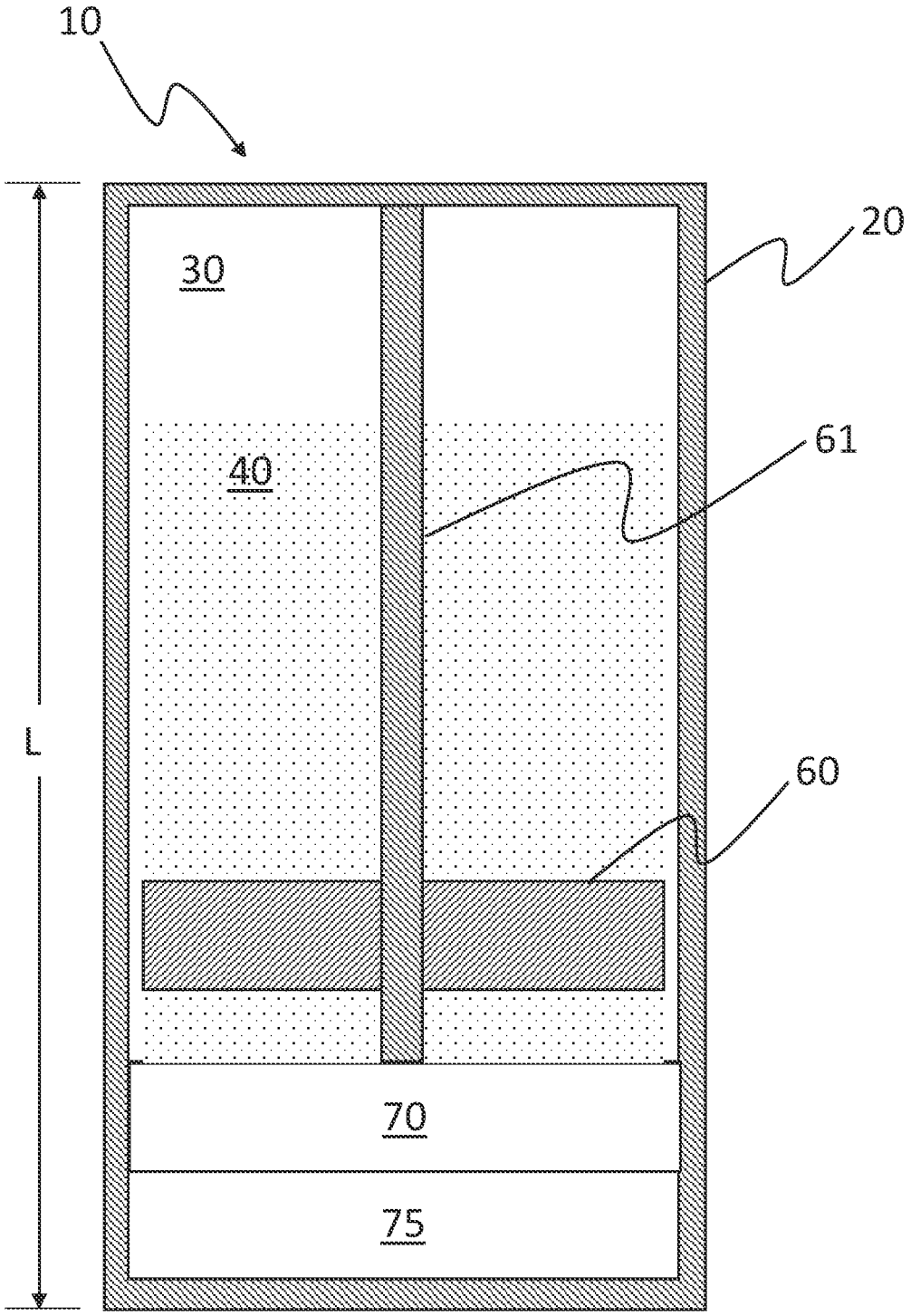
FIG. 1 shows a cross-section of a well tool device for forming a permanent well barrier according to an embodiment of the invention.

FIG. 1 shows a cross-section of a well tool device 10 for forming a permanent well barrier. The well tool device 10 has a housing 20 defining a compartment 30, in which compartment 30 a pyrotechnic mixture 40 is provided.

The housing 20 typically has a circular cross-section and a longitudinal extension with a length L. The cross-section of the housing 20 may alternatively have other shapes, e.g. polygonal. The outer diameter of the well tool device 10 is dimensioned to fit in the inner diameter of the well into which the well tool device 10 shall be installed. The longitudinal extension of the housing 20 may have a length L from 5 meters to 20 meters depending on factors such as required amount of pyrotechnic mixture 40 and size of the required permanent well barrier. The cross-section of the well tool device 10 may be sized in accordance with the tubing and or well in which it is intended to be installed.

A flow generating device 60 may be arranged in the housing 20. The flow generating device 60 may be adapted to generate a forced flow of the pyrotechnic mixture 40 after it has turned into a molten mass when ignited. The flow generating device 60 may be adapted to generate a forced flow of the molten mass created by the heat generating process. In most cases a forced flow in the radial direction from a center axis of the housing is desired; however, an axially directed flow may also be generated.

The flow generating device 60 may be made of a material capable of withstanding the temperature reached by the heat generating process, e.g. a refractory metal such as tungsten.

The flow generating device 60 is typically rotated around an axis (e.g. a center axis of the well tool device 10) to generate a flow of fluids. The flow generating device 60 may be a foldable impeller, a closed impeller, a single-suction impeller, a dual-suction impeller, a paddle impeller, a propeller, a whisk, a ribbon impeller, an anchor impeller, a turbine type impeller, or combinations thereof or any other device suitable for generating a laminar or turbulent flow of liquids, such as a molten mass, either radially or axially. The design of such devices is common general knowledge for a person skilled in the art and will thus not be discussed in detail.

The flow generating device 60 may be arranged closer to the bottom of the compartment 30 than to the top of the compartment 30 when the well tool device 10 is installed in a well. The clearance between the flow generating device 60 and the bottom of the compartment 30 may be 0.3-1.0 meters. The flow generating device 60 is typically arranged in the lower half of the compartment 30.

A motor 70 may be arranged in the well tool device 10 to drive the flow generating device 60. In the embodiment of FIG. 1, the motor 70 is arranged below the flow generating device 60. The motor 70 may be arranged inside the compartment 30 or arranged above or below as an attachment to the housing 20. The motor 70 may be electrically operated.

An energy source 75 adapted to power the motor 70 may be arranged adjacent to the motor 70, either inside the compartment 30 or as an attachment to the housing 20. The energy source 75 may be a battery.

The flow generating device 60 may be provided with a shaft 61. The shaft 61 may be adapted to rotate the flow generating device 60. The shaft 61 may be axially arranged in the well tool device 10 to connect with the motor 70, e.g. arranged concentric with the housing 20. The shaft 61 is preferably pivotally arranged in at least two points of the well tool device 10, e.g. bushings arranged in the top and the bottom of the well tool device 10. The shaft 61 may be connected to the flow generating device 60 by means of a keyed joint. Alternatively, the shaft 61 may be connected to the flow generating device 60 by means of welding. Alternatively, the shaft 61 and the flow generating device 60 may be machined as one item.

The shaft 61 is preferably made of a material capable of withstanding the temperature provided by the heat generating process, e.g. a refractory metal such as tungsten.

After installing one or several well tool devices 10 in a well, the pyrotechnic mixture 40 can be ignited. The pyrotechnic mixture 40 turns into a molten mass after ignition. The motor 70 may start rotating the flow generating device 60 simultaneously with or after the ignition of the pyrotechnic mixture 40. This may be achieved by means of a timer adapted to start the motor 70 at a given time relative to ignition of the pyrotechnic mixture 40. This may also be achieved with a triggering mechanism by means of a temperature sensor. The flow generating device 60 can then in turn create a forced flow of the molten mass. With the appropriate flow generating device 60, the forced flow of the molten mass can be directed in a radial direction from a center line of the housing 20.

Figure 2:
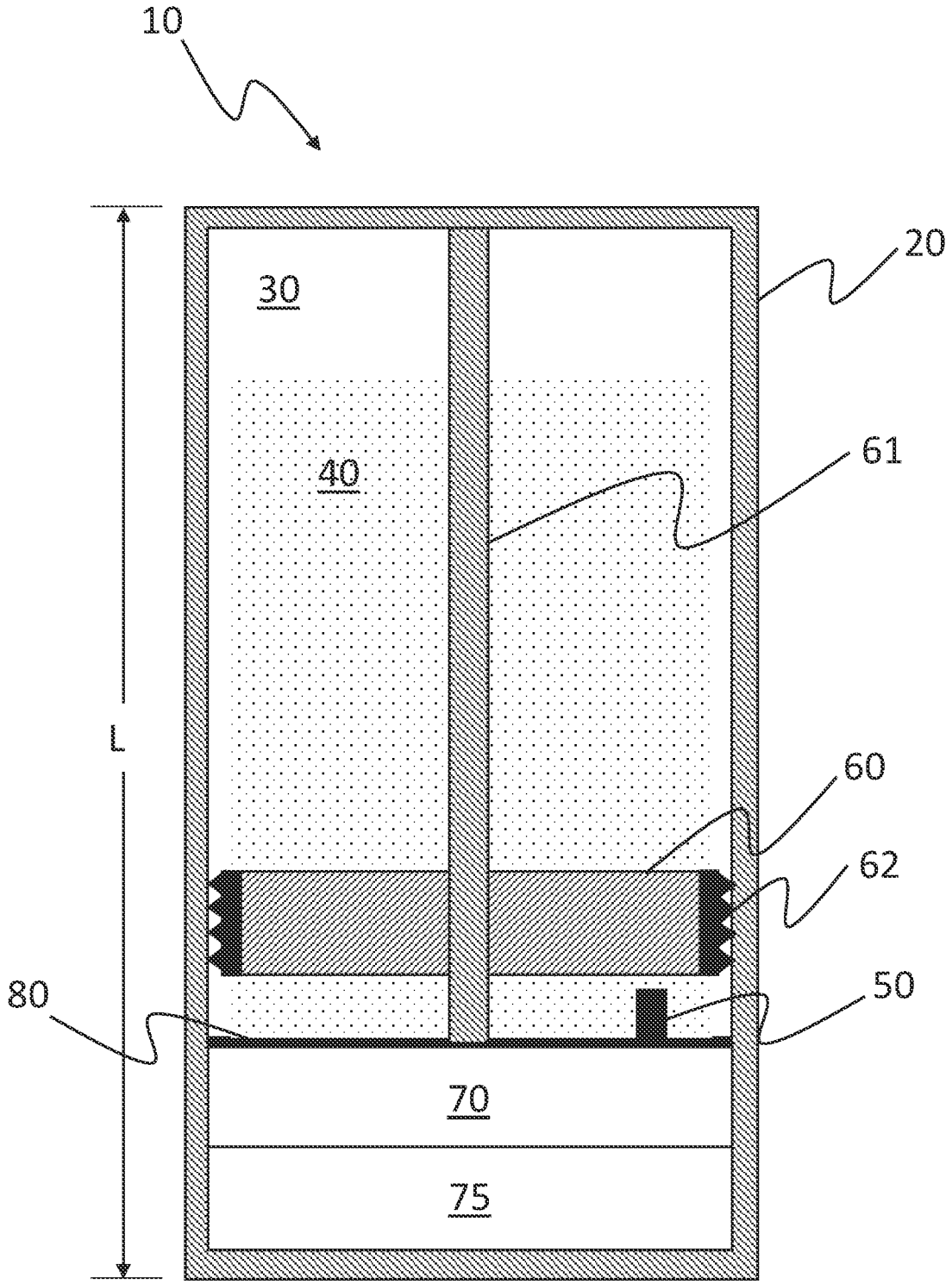
FIG. 2 shows a cross-section of a well tool device for forming a permanent well barrier with some additional features compared to the well tool device 10 disclosed in FIG. 1.

FIG. 2 shows a cross-section of a well tool device 10 for forming a permanent well barrier with some additional features compared to the well tool device 10 disclosed in FIG. 1.

The well tool device 10 in FIG. 2 is provided with an ignition head 50 arranged inside the compartment 30. This ignition head 50 is suitable for igniting the pyrotechnic mixture 40. The ignition head 50 may be powered by the energy source 75.

If several well tool devices 10 are run as a stack or adjacently installed in the well, only one of the well tool devices 10 require an ignition head 50. The pyrotechnic mixture in the first well tool device 10 is ignited by the ignition head 50, this reaction will in turn ignite the surrounding well tool devices 10. The well tool device 10 provided with an ignition head 50 is preferably installed in the well below any other well tool devices 10 not provided with an ignition head 50. All embodiments of the well tool device 10 may or may not be provided with an ignition head 50.

A heat insulating device 80 may be arranged to isolate the motor 70 from the compartment 30. The heat insulating device 80 is preferably made of a material which can withstand the expected temperature of the heat generating process, e.g. a refractory material such as graphite. A heat insulating device 80 may be arranged as the bottom of the compartment 30 when the well tool device 10 is installed in a well, the top of the compartment 30 when the well tool device 10 is installed in a well, as a partition wall in the compartment 30 or any combinations thereof.

During the heat generating process the molten mass will melt and mix with any surrounding material creating a molten mass and thus extend in a radial direction from the center axis of the housing. To improve this radial extension of the molten mass, the flow generating device 60 may be adapted to expand radially. By being radially expandable, the flow generating device 60 will improve the supply of heat from the molten mass to these radially extended areas.

The flow generating device 60 may be a foldable impeller which expands in a radial direction from the center axis of the housing in response to a speed of rotation, i.e. mechanically expandable. A flow generating device 60 in the form of a foldable impeller typically has hinged blades which folds out as the impeller rotates. The length of such blades is preferably dimensioned based on the desired radial extension of the molten mass, and thus the size of the permanent well barrier.

As the molten mass gradually extends, the blades of the flow generating device 60 may gradually expand. Before the molten mass has reached the intended radial extension, the foldable blades of the flow generating device 60 may scrape the surface of surrounding materials. The flow generating device 60 may therefore be provided with durable tips adapted to scrape any contacting surface while maintaining their structural integrity. Such durable tips 62 will improve the radial extension of the molten mass. The durable tips 62 may also be adapted to tear off parts from the surrounding surfaces on which they scrape, e.g. by being provided with a rough surface, spikes, sharp edges or the like.

Figure 3:
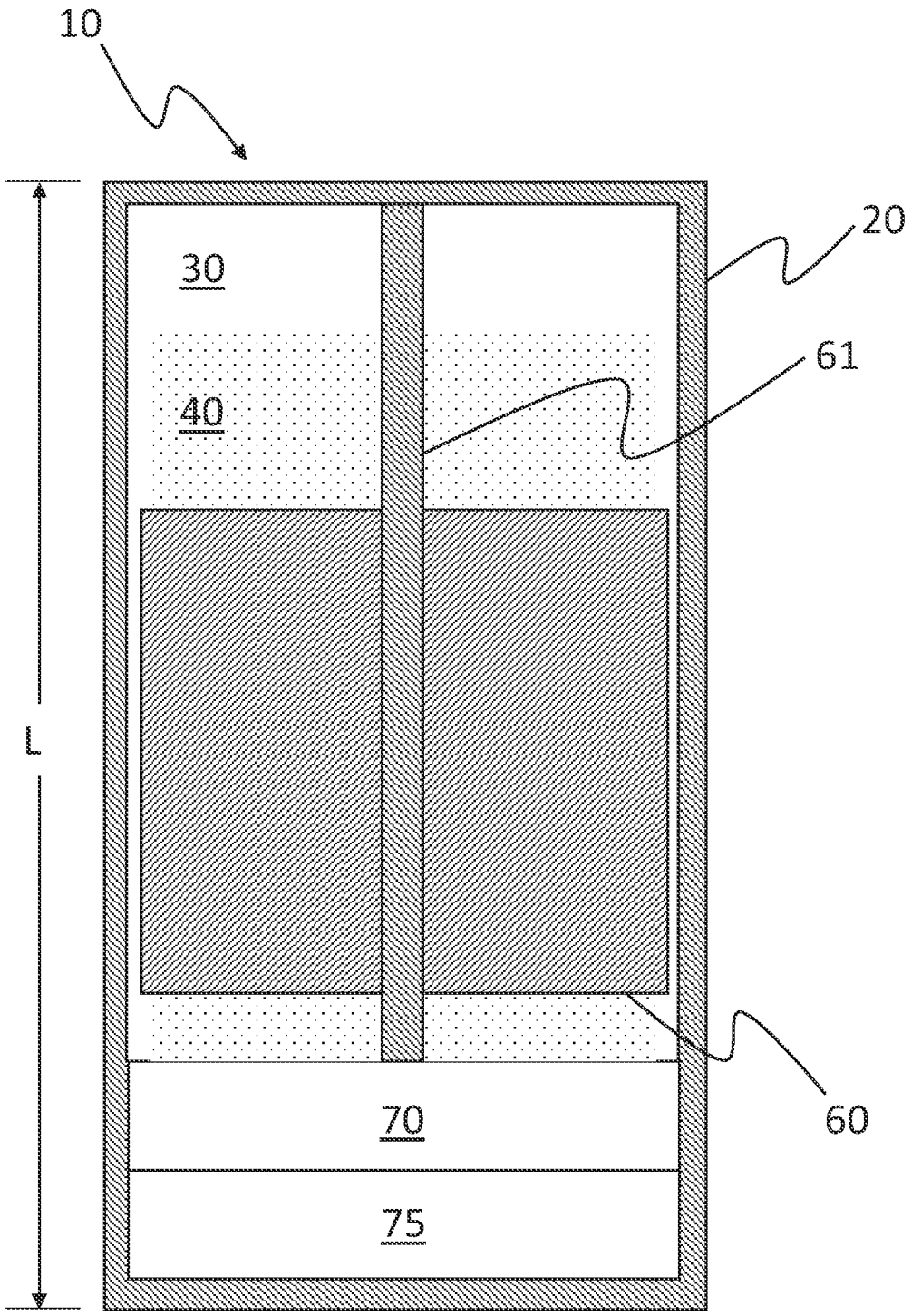
FIG. 3 shows a cross-section of a well tool device for forming a permanent well barrier which is similar to the embodiment of FIG. 1 except that the flow generating device is replaced with a flow generating device of a different size.

FIG. 3 shows a cross-section of a well tool device 10 for forming a permanent well barrier which is similar to the embodiment of FIG. 1 except that the flow generating device 60 is replaced with a flow generating device 60 of a different size. This embodiment of the well tool device 10 may additionally also comprise any of the features of the embodiment of FIG. 2.

The flow generating device 60 of FIG. 3 has an axial length extending at least half the axial length of the compartment 30. Whereas the flow generating device 60 of FIG. 1 has an axial length extending less than half the axial length of the compartment 30.

Figure 4:
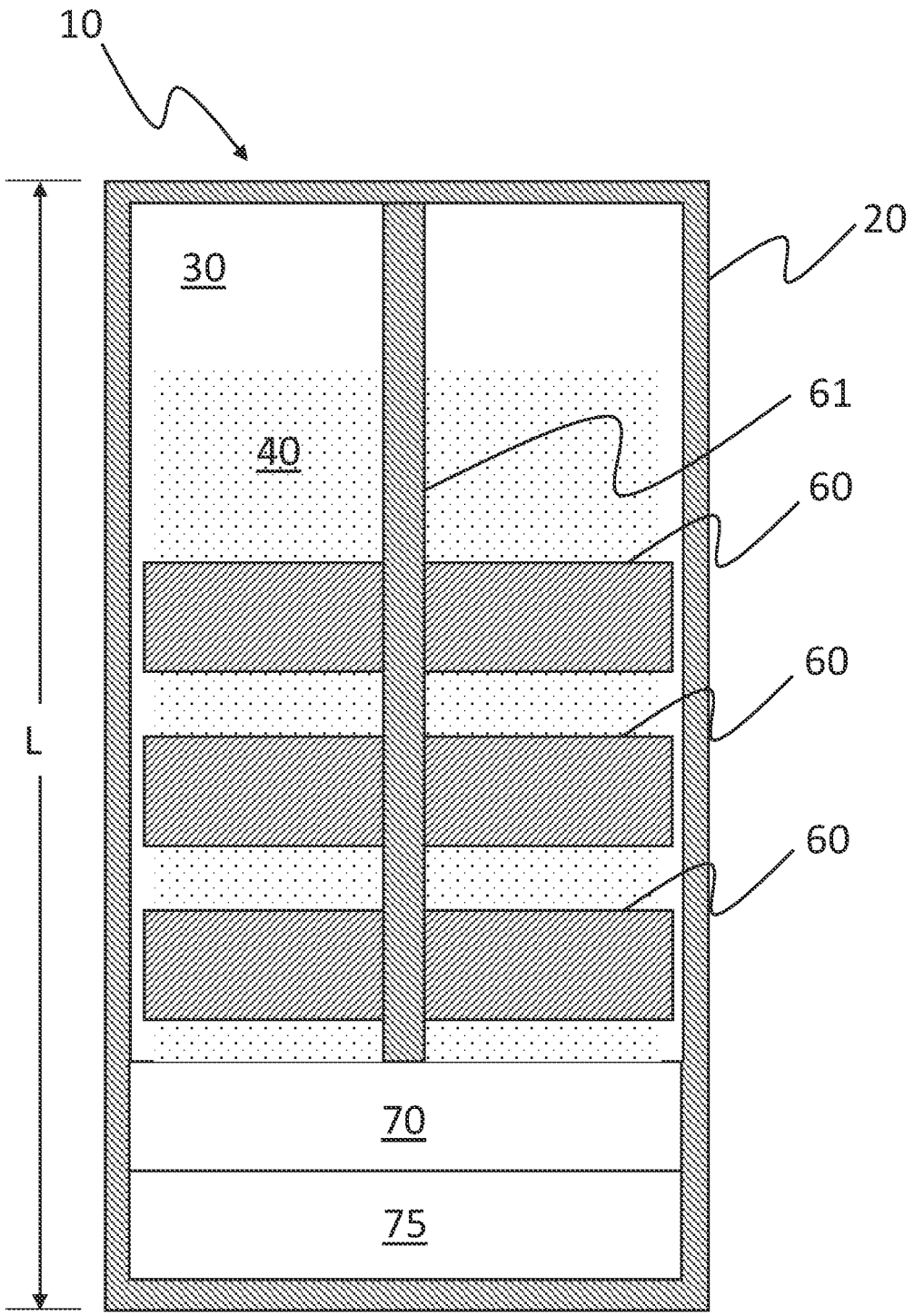
FIG. 4 shows a cross-section of a well tool device for forming a permanent well barrier, similar to the embodiment of FIG. 1 except that the well tool device has a plurality of flow generating devices.

FIG. 4 shows a cross-section of a well tool device 10 for forming a permanent well barrier, similar to the embodiment of FIG. 1 except that the well tool device has a plurality of flow generating devices 60. This embodiment of the well tool device 10 may additionally also comprise any of the features of the embodiment of FIG. 2.

The flow generating device 10 of FIG. 4 has three flow generating devices 60. A person skilled in the art would understand that any number of flow generating devices 60 may be arranged in the compartment 30 of the well tool device 10. The plurality of flow generating devices 60 are disclosed arranged on the same shaft 61, however they may also be arranged on parallel shafts. The plurality of flow generating devices 60 may be of the same type or of different types. The plurality of flow generating devices 60 may be of the same size or of different sizes.

Figure 5:
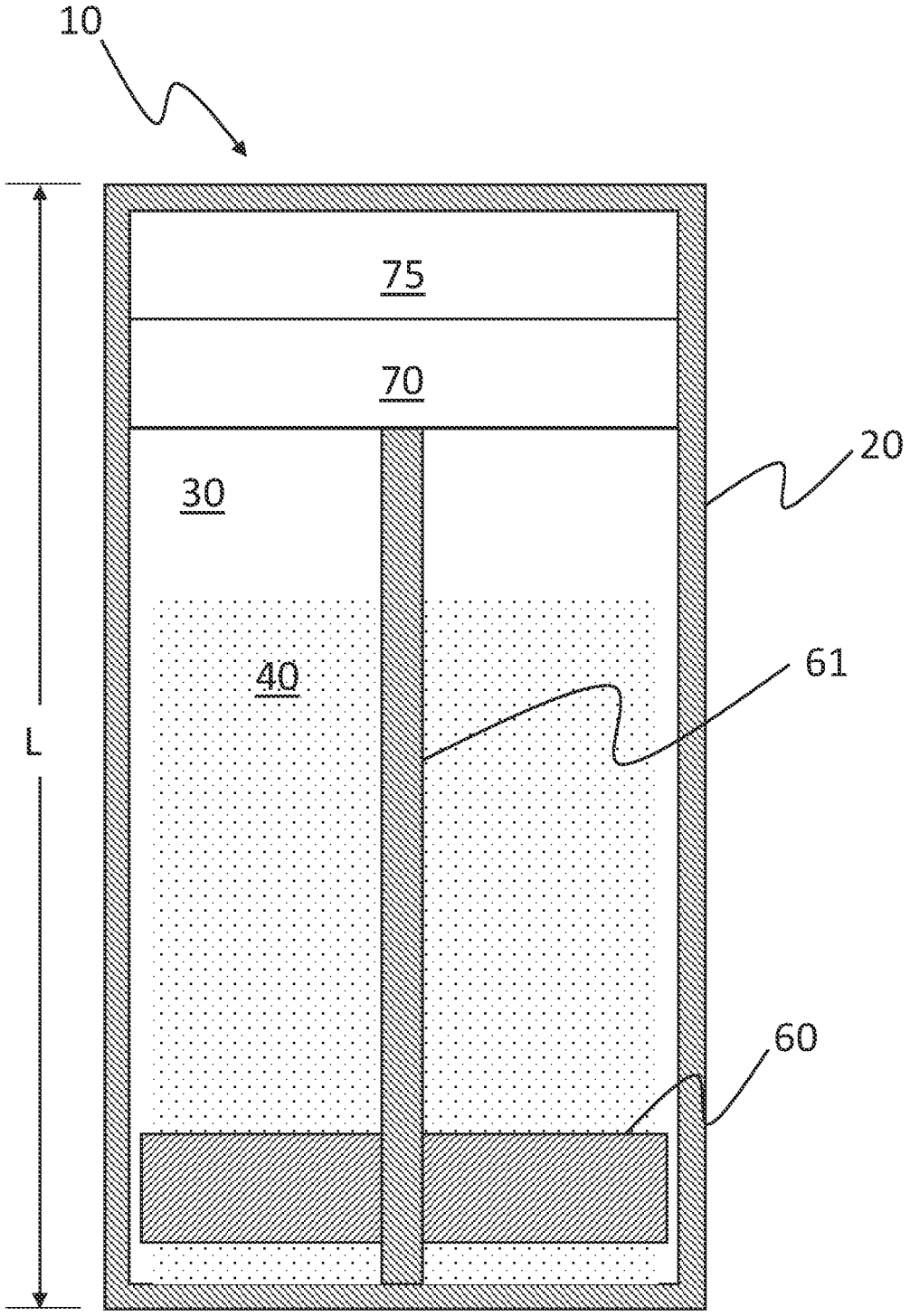
FIG. 5 shows a cross-section of a well tool device for forming a permanent well barrier, the well tool device is similar to the embodiment of FIG. 1 except that the motor and the energy source are differently arranged.

FIG. 5 shows a cross-section of a well tool device 10 for forming a permanent well barrier, the well tool device is similar to the embodiment of FIG. 1 except that the motor 70 and the energy source 75 are differently arranged. This embodiment of the well tool device 10 may additionally also comprise any of the features of the embodiments of FIGS. 2, 3 and 4.

In the embodiment of FIG. 5, the motor 70 is arranged above the flow generating device 60. The motor 70 may be arranged inside the compartment 30. The motor 70 may also be arranged above or below as an attachment to the housing 20.

The energy source 75 may be arranged adjacent to the motor 70, either inside the compartment 30 or above or below as an attachment to the housing 20. The energy source 75 may also be located topside. The energy source 75 may be a battery, a generator or a power grid.

Figure 6:
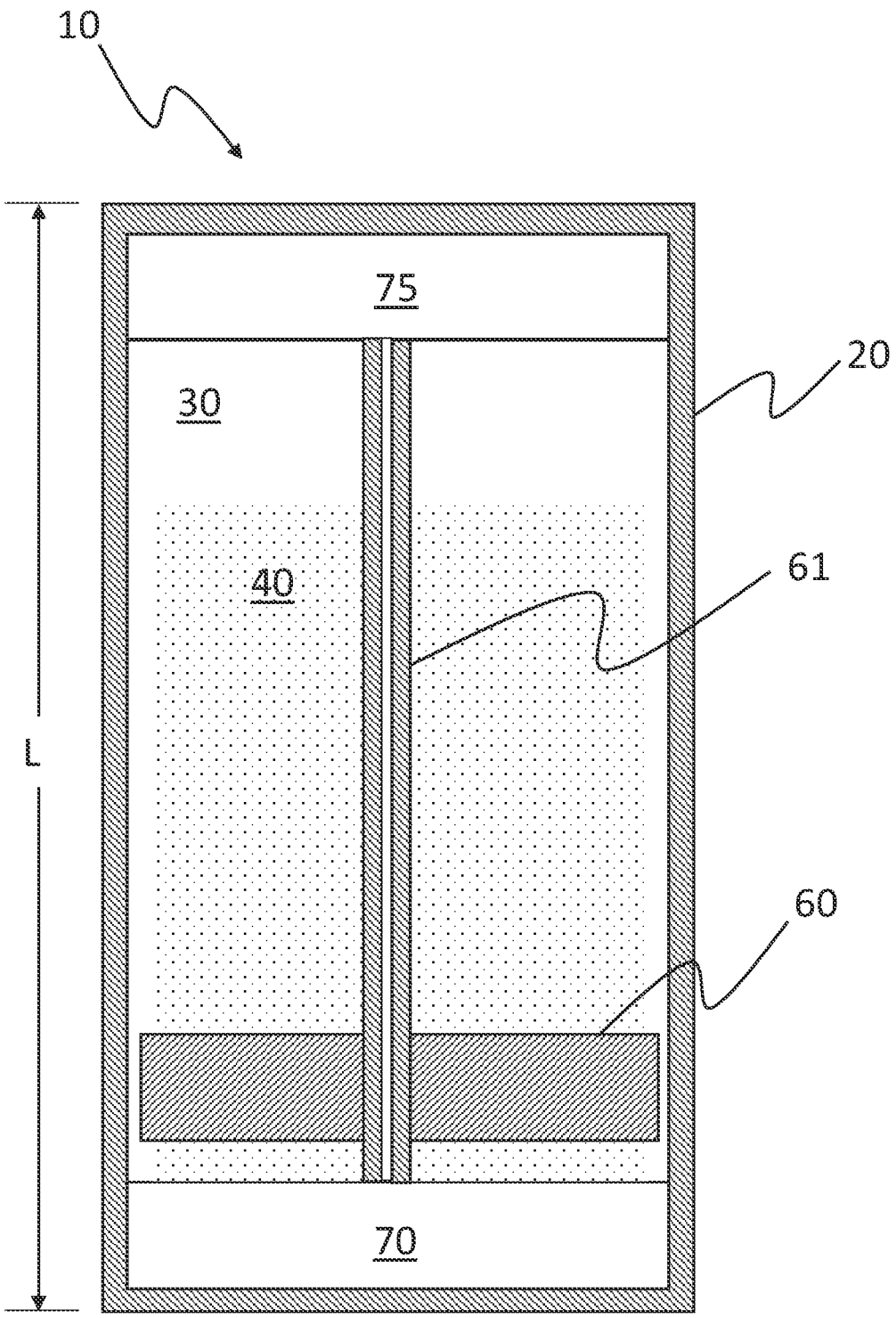
FIG. 6 shows a cross-section of a well tool device for forming a permanent well barrier, the well tool device is similar to the embodiment of FIG. 1 except that the energy source is differently arranged and that it has an alternative embodiment of the shaft.

FIG. 6 shows a cross-section of a well tool device 10 for forming a permanent well barrier, the well tool device 10 is similar to the embodiment of FIG. 1 except that the energy source 75 is differently arranged and that it has an alternative embodiment of the shaft 61. This embodiment of the well tool device 10 may additionally also comprise any of the features of the embodiment of FIGS. 2, 3 and 4.

In the embodiment of FIG. 6, the shaft 61 has a concentric through hole, whereas the shaft 61 of the other embodiments are solid. The through hole in the shaft 61 enables communication between the two sides of the housing 20 to which the shaft 61 is arranged.

In the embodiment of FIG. 6, the motor 70 and the energy source 75 are arranged on opposite sides of the housing 20. The motor 70 is connected to the energy source 75 via a power cord arranged through the through hole of the shaft 61. This embodiment provides the possibility of arranging the motor 70 below the flow generating device 60 when the well tool device 10 is installed in a well, while arranging the energy source 75 topside.

Figure 7:
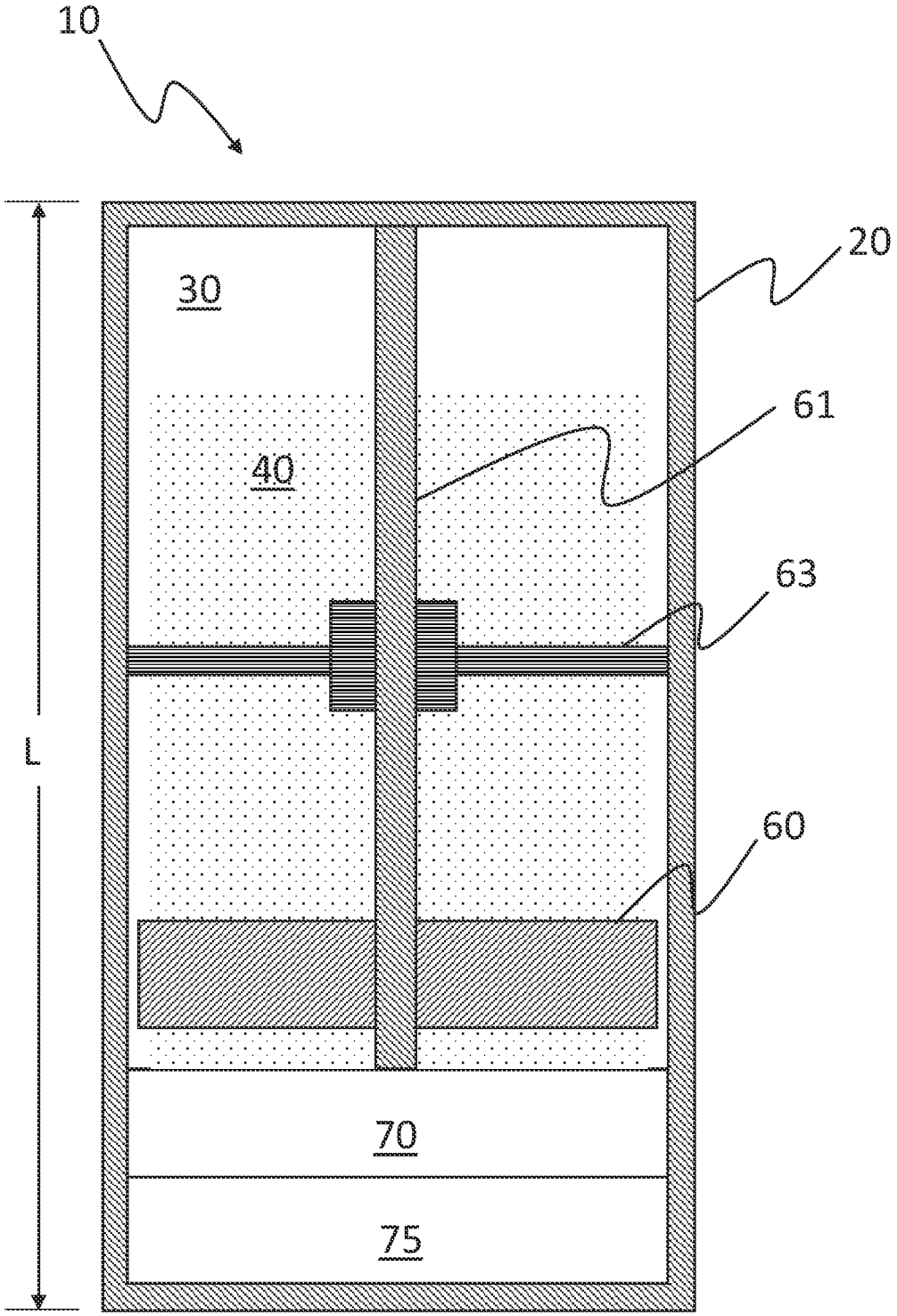
FIG. 7 shows a cross-section of a well tool device for forming a permanent well barrier, the well tool device is similar to the embodiment of FIG. 1 except that it has a support device.

FIG. 7 shows a cross-section of a well tool device 10 for forming a permanent well barrier, the well tool device 10 is similar to the embodiment of FIG. 1, except that it has a support device 63. The support device 63 is arranged in the compartment 30 of the well tool device 10.

The support device 63 may provide a bushing device concentric with a compartment 30 of circular cross-section. The support device may comprise spokes, beams, or similar arranging the support device to the housing 20. The support device 62 may be made of the same material as the flow generating device 60 or any other material suitable for withstanding the temperature of the molten mass.

The bushing device of the support device 63 may have a through hole adapted to house a shaft 61 which endpoints are arranged outside of the bushing device. One or several flow generating devices 60 may be arranged on one or both sides of the support device 63.

The support device 63 may be arranged at an equal distance from each endpoint.

Figure 8:
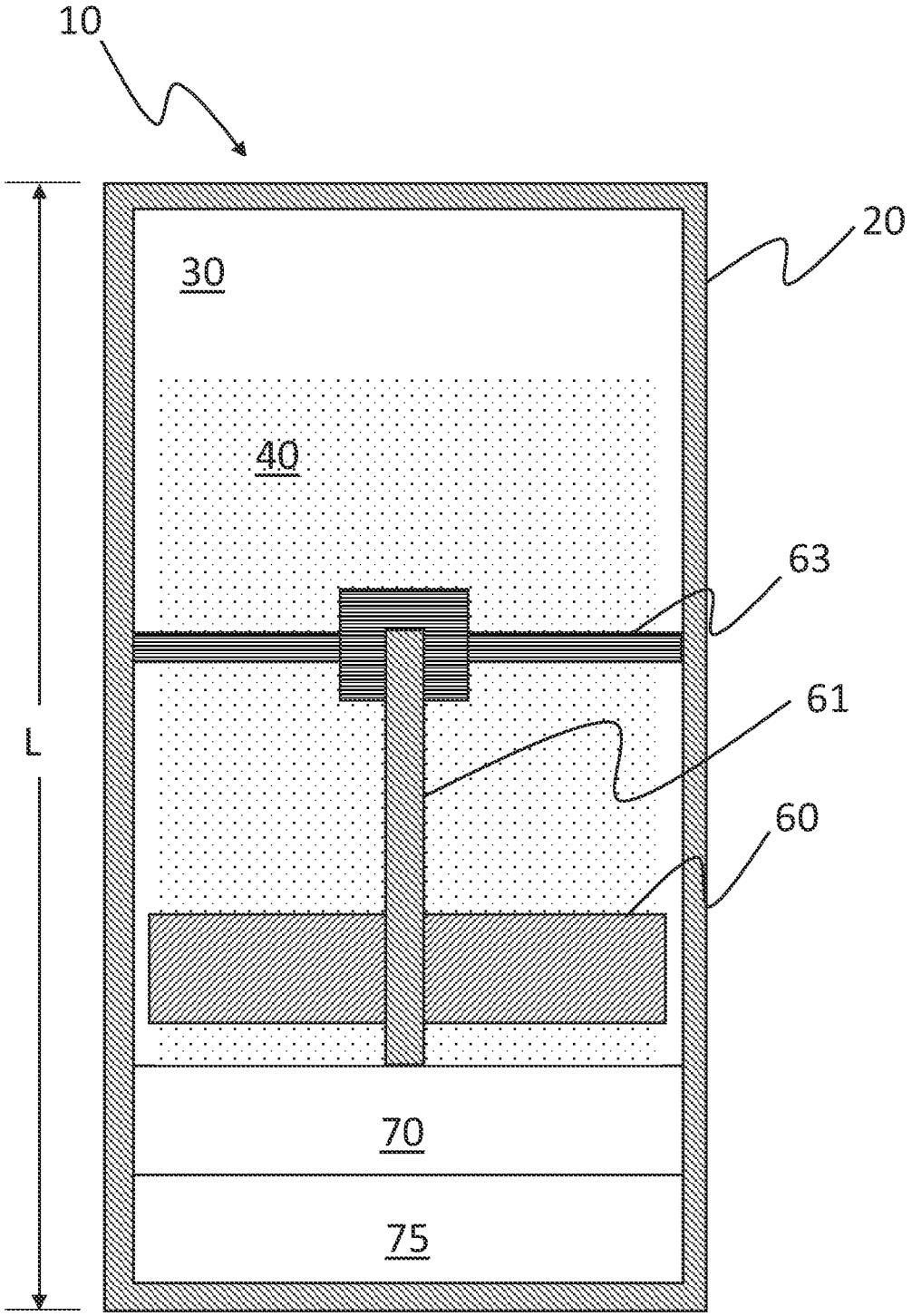
FIG. 8 shows a cross-section of a well tool device for forming a permanent well barrier, the well tool device is similar to the embodiment of FIG. 7 except it has a shorter shaft, i.e. only one endpoint of the shaft 61 is arranged in the housing 20.

FIG. 8 shows a cross-section of a well tool device 10 for forming a permanent well barrier, the well tool device 10 is similar to the embodiment of FIG. 7, except that the shaft 61 is shorter, i.e. only one endpoint of the shaft 61 is arranged in the housing 20.

The bushing device of the support device 63 may be adapted to house an endpoint of the shaft 61.

Figure 9:
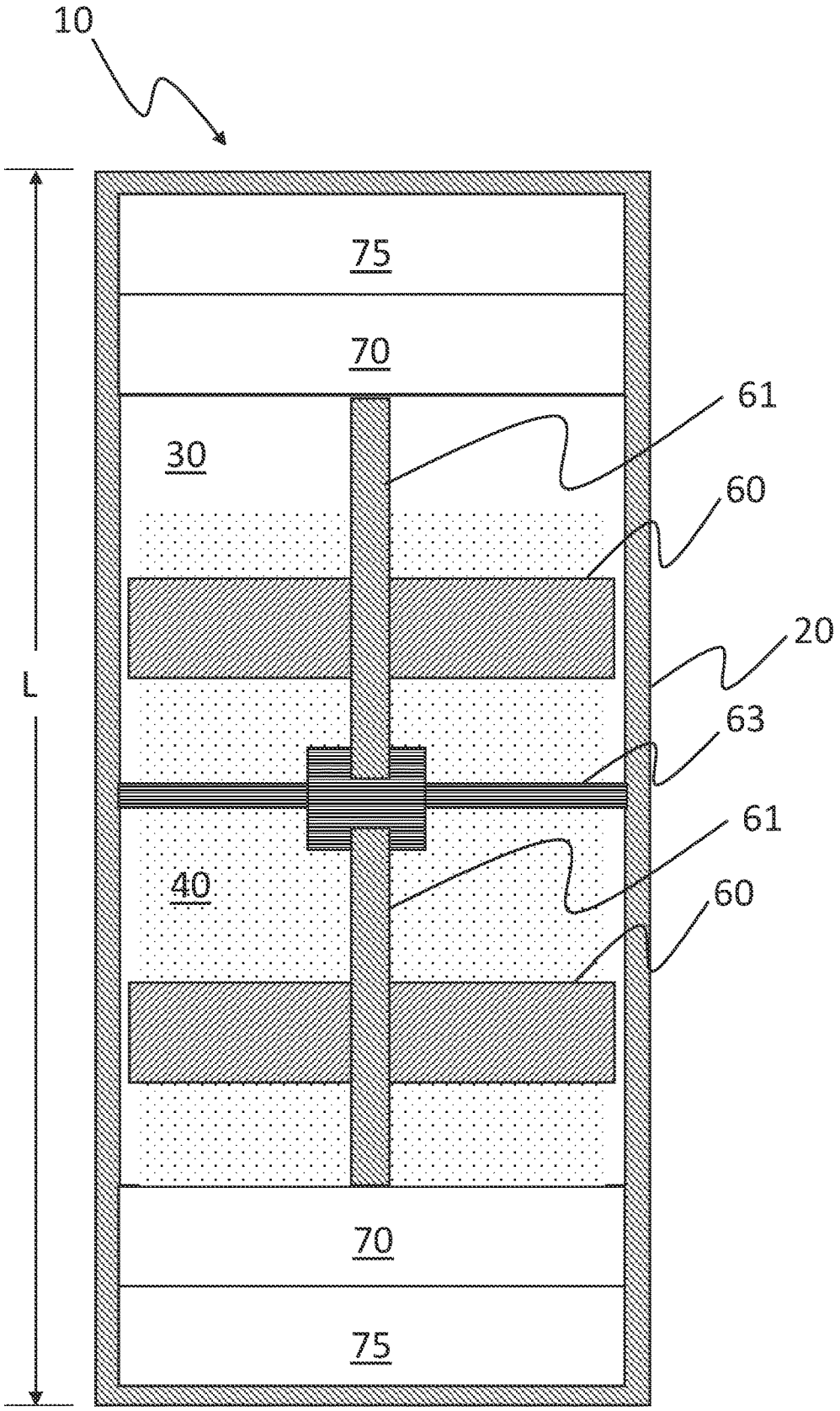
FIG. 9 shows a cross-section of a well tool device for forming a permanent well barrier, the well tool device is similar to the embodiment of FIG. 7 except it has a double set of energy source, motor, shaft and flow generating device.

FIG. 9 shows a cross-section of a well tool device 10 for forming a permanent well barrier, the well tool device 10 is similar to the embodiment of FIG. 7, except that it has a double set of energy source 75, motor 70, shaft 61 and flow generating device 60.

A set of energy source 75 and motor 70 may be arranged on opposite sides of the well tool device 10. Each set of energy source 75 and motor 70 may drive one shaft 61 each.

The bushing device of the support device 63 may be adapted to house both shafts 61 which each has one endpoint arranged in the bushing device at opposite sides. The shafts 61 may be of different lengths if they can be arranged such that they both have one endpoint housed in the support device 63. Alternatively, two support devices 63 may be arranged in the housing 20, each adapted to house an endpoint of a shaft 61.

Figure 10:
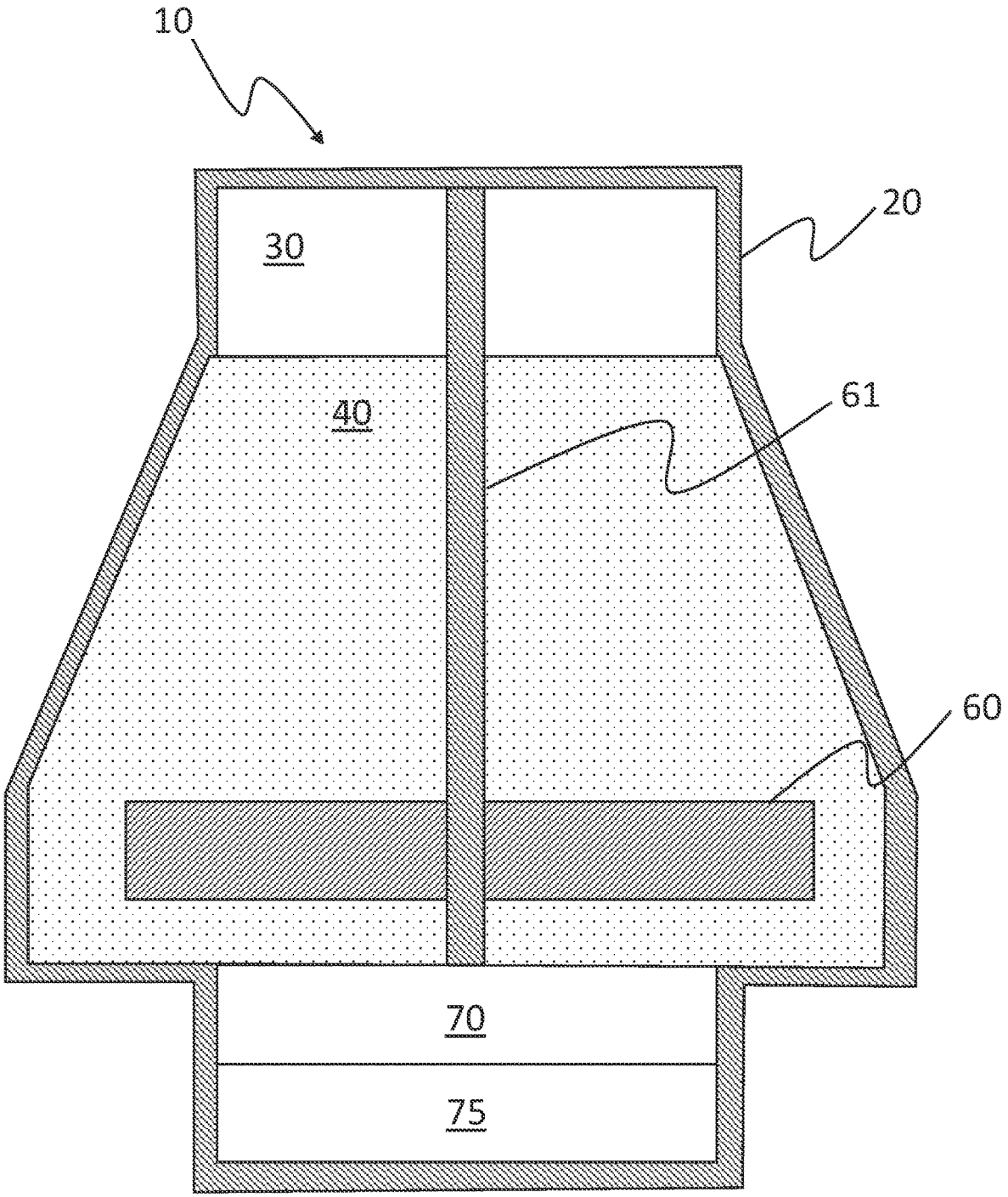
FIG. 10 shows a cross-section of a well tool device for forming a permanent well barrier, the well tool device is similar to the embodiment of FIG. 1 wherein the flow generating device is of the mechanically expandable type.

FIG. 10 shows a cross-section of a well tool device 10 for forming a permanent well barrier, the well tool device 10 is similar to the embodiment of FIG. 1 wherein the flow generating device 60 is of the mechanically expandable type. This embodiment of the well tool device 10 may additionally also comprise any of the features of the embodiment of FIGS. 2, 3 and 4.

In FIG. 8, parts of the housing 20 has been melted by the molten mass. The molten mass has extended in a radial direction from the center axis of the housing beyond what was earlier defined by the compartment 30 inside the housing 20. In addition, the flow generating device 60 has expanded radially beyond what was earlier defined by the compartment 30.

The foldable flow generating device 60 may gradually expand as its speed of rotation is gradually increased. The foldable flow generating device 60 may also be rotated at a speed sufficient to fully expand the flow generating device 60 but be held back by its surroundings. In such case the foldable flow generating device 60 will gradually expand as its surroundings melt.

Figure 11:
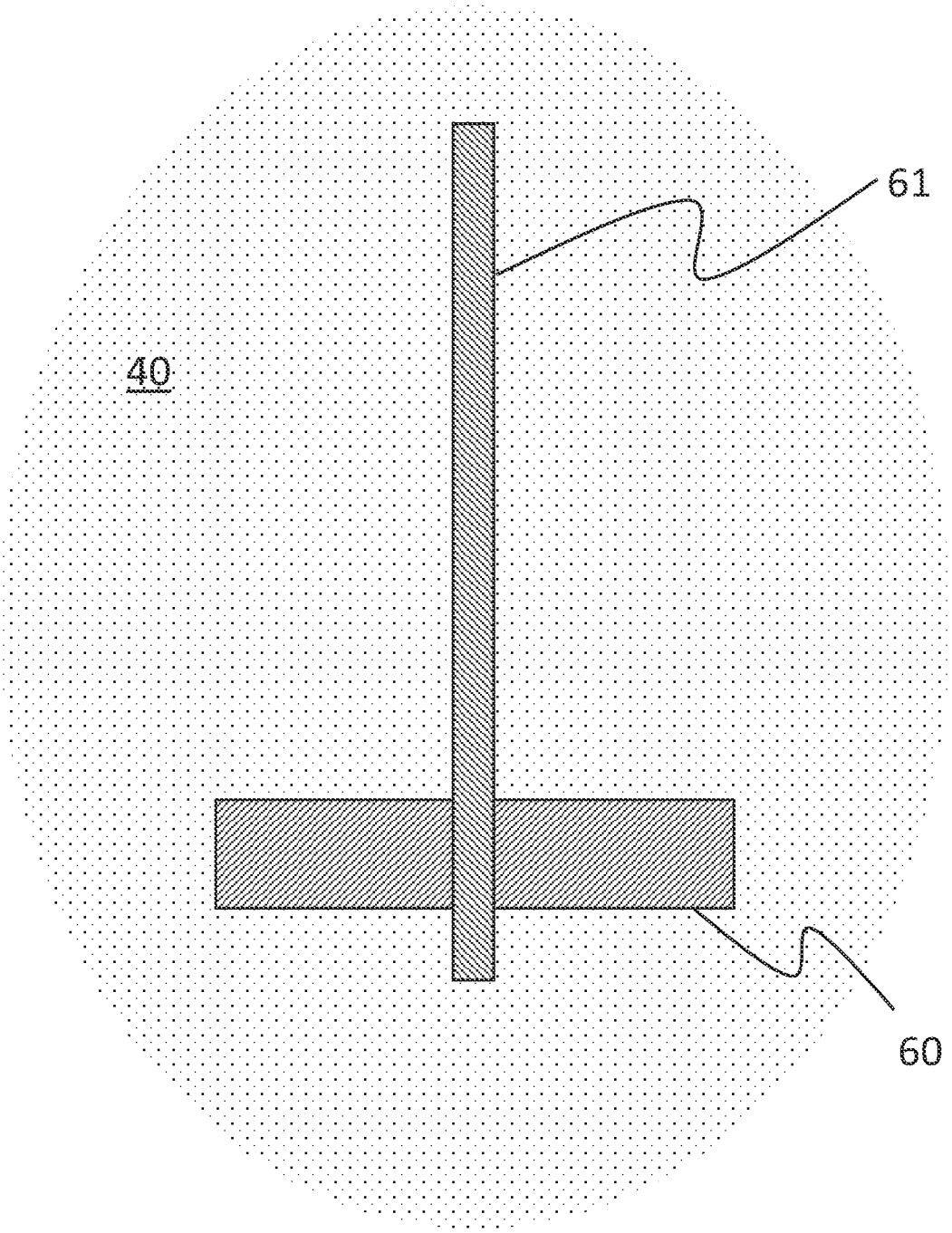
FIG. 11 shows a cross-section of a melted well tool device for forming a permanent well barrier after melting of the pyrotechnic mixture and any surrounding materials.

FIG. 11 shows a cross-section of a melted well tool device 10 for forming a permanent well barrier after melting of the pyrotechnic mixture and any surrounding materials. Only the flow generating device 60 and the shaft 61 is in a solid phase. The molten mass has completely enclosed the flow generating device 60 and the shaft 61. The flow generating device 60 and the shaft 61 may be part of the solidified permanent well barrier or they may drift out of the melt before it solidifies.

In one embodiment of the well tool device 10, the pyrotechnic mixture 40 may be adapted to reach a maximum temperature which is in the same range as the melting point of the flow generating device 60 and the shaft 61. In such an embodiment the flow generating device 60 may generate a forced flow of liquids, such as the molten mass, in a first phase before melting in a second phase.

Figure 12:
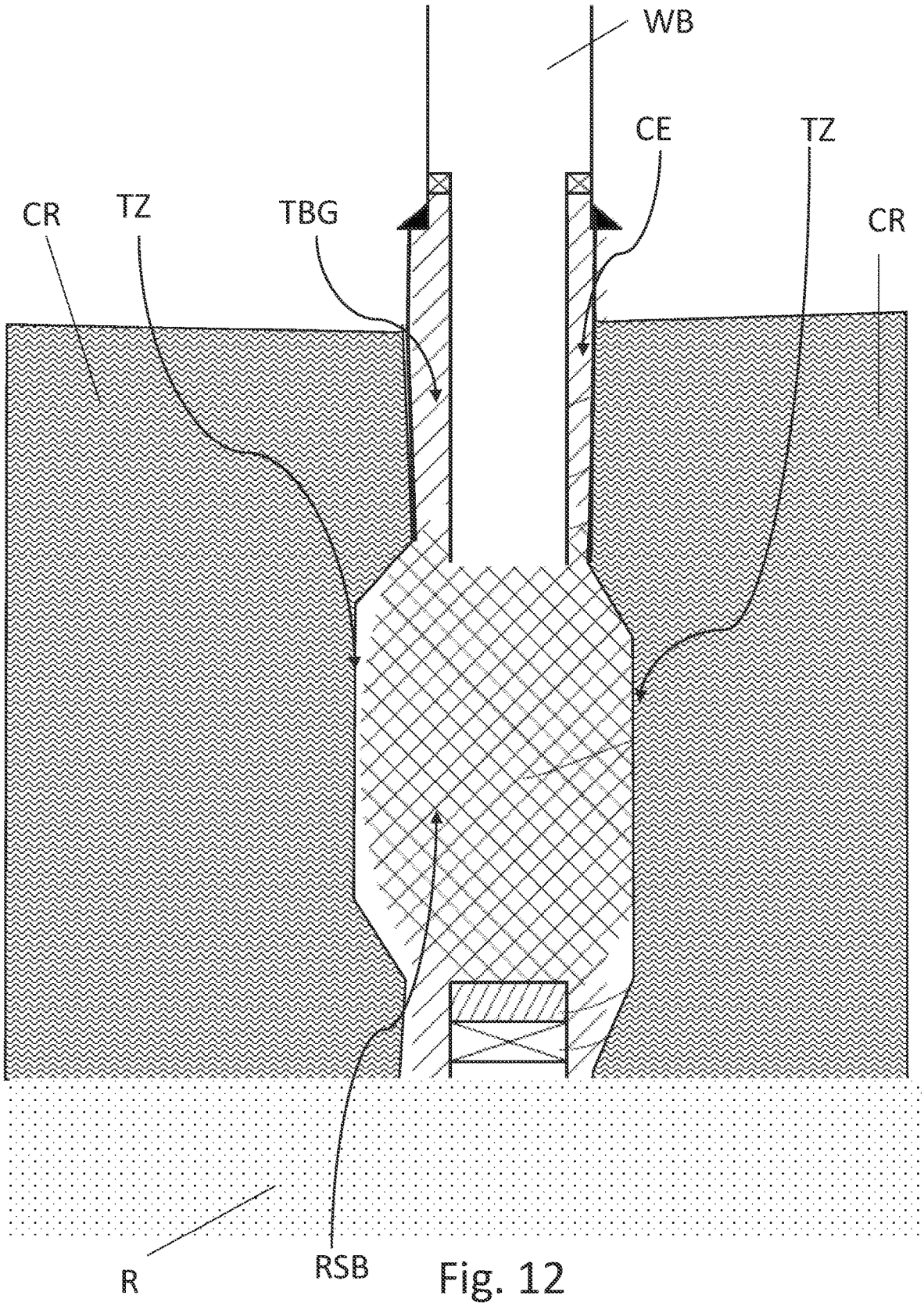
FIG. 12 shows the situation in a well after ignition of the pyrotechnic mixture.

FIG. 12 shows a cross-section of the well along a vertical plane after the ignition of the pyrotechnic mixture 40 such that proximate surrounding materials present at the position of the pyrotechnic mixture 40 have melted, e.g. tubing or liner TBG, cement CE, cap rock CR, well tool device 10, well tool device housing 20, igniting head 50, other tubulars etc. After waiting a period of time, the melted surrounding materials have solidified into a reservoir sealing barrier or permanent well barrier RSB which seals against the reservoir R in the well bore WB. The sketched area formed in the well bore WB and extending radially into the cap rock CR indicates the melted surrounding materials (i.e. the reservoir sealing barrier RSB which has been formed). The transition areas between non-affected cap rock CR and complete melted materials now forming part of the reservoir sealing barrier RSB is denoted transition zone TZ. In order for a successful reservoir sealing barrier RSB to form, it is advantageous that the bonding between the cap rock CR and the reservoir sealing barrier is satisfactory. Whether the reservoir sealing barrier seals against the reservoir, including in the transition zone, verification test such as pressure tests or sample test(s) of substances not naturally occurring above reservoir sealing barrier RSB can be performed. Such sample tests may be e.g. H2S or other gases. The pressure tests may monitor whether the pressure above the reservoir sealing barrier increases or not.

The invention is herein described in non-limiting embodiments. It should though be understood that the embodiments may be envisaged with a stack comprising two or more well tool devices. The skilled person will understand if it is desirable to set none, one, two or several permanent plugs dependent on the desired operation. Similarly, high temperature resistant elements may be provided at dedicated positions in the well to protect parts of the well or equipment lying contiguous, above or below the position where the plus is set, and may vary from zero, one, two or several, dependent on the operation.

REFERENCE LIST

10—well tool device
20—housing
30—compartment
40—pyrotechnic mixture
50—ignition device
60—flow generating device
  61—shaft
  62—durable tip
  63—support device
70—motor
  75—energy source
80—heat insulating device
CE—Cement
WB—well bore
CR—Cap rock
L—longitudinal length of well tool device
R—Reservoir
RSB—reservoir sealing barrier/permanent well barrier
TBG—Tubing
TZ—Transition zone

The invention claimed is:

1. A well tool device for forming a permanent well barrier, wherein the well tool device comprises:
- a housing having a circular cross-section and a longitudinal extension, defining an outer periphery of the well tool device;
- a pyrotechnic mixture provided in the housing;
- a flow generating device provided in the housing;
- a motor provided in the housing for driving the flow generating device; and
- an ignition device provided in the housing,
- wherein the pyrotechnic mixture, the flow generating device, the motor, and the ignition device are provided in one compartment in the housing;
- wherein the pyrotechnic mixture is configured to turn into a molten mass after ignition using the ignition device; and
- wherein the flow generating device is configured to generate a forced flow of the molten mass.

2. The well tool device according to claim 1, wherein the flow generating device is a foldable impeller, a closed impeller, a single-suction impeller, a dual-suction impeller, a paddle impeller, a propeller, a whisk, a ribbon impeller, an anchor impeller, a turbine type impeller, or combinations thereof.

3. The well tool device according to claim 1,
- wherein the flow generating device is a foldable impeller with a plurality of foldable blades;
- wherein rotation of the flow generating device causes the blades to unfold and the plurality of blades rotate in a circular cross-section which extends beyond the circular cross-section of the housing when the blades are fully unfolded and when a part of the housing is melted by the molten mass.

4. The well tool device according to claim 3,
- wherein the foldable blades are provided with tips adapted to scrape any contacting surface while maintaining their structural integrity.

5. The well tool device according to claim 1, wherein the flow generating device is made from a material with a higher melting point then the temperature of the molten mass.

6. The well tool device according to claim 1, wherein the flow generating device is adapted to generate a forced flow of fluids directed in a radial direction from a center axis of the housing.

7. The well tool device according to claim 1, wherein the well tool device comprises:

an energy source for powering the motor.

8. The well tool device according to claim 1, wherein the flow generating device comprises:

a shaft for connecting the flow generating device to the motor;

wherein the shaft is concentric with the housing.

9. The well tool device according to claim 1, wherein the motor is arranged below the flow generating device when the well tool device is installed in a well.

10. The well tool device according to claim 1, wherein the well tool device comprises:

a plurality of flow generating devices;

wherein the flow generating devices are axially arranged relative each other on the same shaft.

11. The well tool device according to claim 1, wherein the pyrotechnic mixture comprises thermite.

12. A method for forming a permanent well barrier using a well tool device, the well tool device comprising:

a housing having a circular cross-section and a longitudinal extension, defining an outer periphery of the well tool device;

a pyrotechnic mixture provided in the housing;

a flow generating device provided in the housing;

a motor for driving the flow generating device; and an ignition device provided in the housing, wherein the pyrotechnic mixture, the flow generating device, the motor, and the ignition device are provided in one compartment in the housing;

wherein the flow generating device is configured to generate a forced flow of fluids within the housing;

wherein the method comprises the steps of:

installing the well tool device in a well;

igniting the pyrotechnic mixture, by the ignition device provided in the housing, the pyrotechnic mixture turns into a molten mass upon ignition;

starting the motor provided in the housing; and generating a forced flow of molten mass by means of the flow generating device provided in the housing.

13. The method according to claim 12, wherein the method comprises:

directing the forced flow of fluids in a radial direction of the housing.

14. The method according to claim 12, wherein the flow generating device comprises:

a foldable impeller with a plurality of foldable blades;

wherein the method comprises:

unfolding the foldable blades of the foldable impeller by means of increasing the rotational speed of the flow generating device.

15. The method according to claim 14, wherein the foldable blades are provided with reinforced tips adapted to scrape any contacting surface while maintain their structural integrity;

wherein the method comprises:

scraping the surface of a surrounding solid-state material by means of the tips of the foldable impeller blades.

* * * * *